US010744772B2

(12) United States Patent
Murashima et al.

(10) Patent No.: US 10,744,772 B2
(45) Date of Patent: Aug. 18, 2020

(54) INKJET RECORDING APPARATUS

(71) Applicant: KYOCERA Document Solutions Inc., Osaka (JP)

(72) Inventors: Masaki Murashima, Osaka (JP); Yasuyuki Fukunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/439,900

(22) Filed: Jun. 13, 2019

(65) Prior Publication Data

US 2019/0389204 A1 Dec. 26, 2019

(30) Foreign Application Priority Data

Jun. 20, 2018 (JP) ..... 2018-116969

(51) Int. Cl.
*B41J 2/165* (2006.01)
*B41J 2/17* (2006.01)

(52) U.S. Cl.
CPC ..... *B41J 2/16523* (2013.01); *B41J 2/16547* (2013.01); *B41J 2/16585* (2013.01); *B41J 2/1721* (2013.01); *B41J 2002/16591* (2013.01)

(58) Field of Classification Search
CPC ..... B41J 2/16523; B41J 2/1721; B41J 2002/1856; B41J 2/185
See application file for complete search history.

(56) References Cited

U.S. PATENT DOCUMENTS

2018/0244046 A1* 8/2018 Nakamura ..... B41J 2/18

FOREIGN PATENT DOCUMENTS

JP H11-115209 A 4/1999
JP 2008302310 * 12/2008 ..... B41J 2/185

* cited by examiner

*Primary Examiner* — Julian D Huffman
(74) *Attorney, Agent, or Firm* — Studebaker & Brackett PC

(57) ABSTRACT

An inkjet recording apparatus includes a recording head, a waste ink tray, an ink inflow section, an ink detecting section, and a controller. The recording head ejects ink. The waste ink tray recovers the ink. The ink inflow section is located on the waste ink tray. The ink flows into the ink inflow section. The ink detecting section outputs a detection signal indicating whether there is the ink or not. The ink inflow section has a first inflow opening and a second inflow opening. The second inflow opening is located at a position higher than a position of the first inflow opening. The ink detecting section detects whether or not the ink has flown into the second inflow opening. The controller, upon receiving the detection signal, detects that the first inflow opening is clogged.

7 Claims, 14 Drawing Sheets

INKJET RECORDING APPARATUS

INCORPORATION BY REFERENCE

The present application claims priority under 35 U.S.C. § 119 to Japanese Patent Application No. 2018-116969, filed on Jun. 20, 2018. The contents of this application are incorporated herein by reference in their entirety.

BACKGROUND

The present disclosure relates to an inkjet recording apparatus.

Various inkjet recording apparatuses that recover ink discharged by purging have been disclosed. For example, an image recording apparatus reuses ink discharged by purging. This image recording apparatus includes a recording head, a carriage, a guide bar, a purging device, and an ink recovery container. The recording head ejects ink toward a recording medium. The carriage holds the recording head and moves in a main scanning direction along the guide bar. The recording head performs recording on the recording medium as the carriage moves. The purging device causes the recording head to discharge ink in order to remove air bubbles generated in the ink. The ink recovery container recovers the ink discharged by the purging device. The ink recovery container includes a plurality of ink storage sections and an ink tray. The plurality of ink storage sections are separated from each other by a partition wall. The partition wall is set to have a height lower than that of an outer frame of the ink recovery container. The ink tray guides the ink discharged from the recording head by the purging device to the ink an adjacent storage sections. When one of the ink storage sections becomes full, the ink flows into ink reservoir section adjacent thereto. When this ink storage section becomes full, the ink flows into still adjacent ink reservoir section adjacent thereto, and this is repeated sequentially.

SUMMARY

An inkjet recording apparatus according to the present disclosure includes a recording head, a waste ink tray, an ink inflow section, an ink detecting section, and a controller. The recording head ejects ink. The waste ink tray recovers the ink. The ink inflow section is located on the waste ink tray. The ink flows into the ink inflow section. The ink detecting section outputs a detection signal indicating whether there is the ink or not. The ink inflow section has a first inflow opening and a second inflow opening. The second inflow opening is located at a position higher than a position of the first inflow opening. The ink detecting section detects whether or not the ink has flown into the second inflow opening. The controller, upon receiving the detection signal, detects that the first inflow opening is clogged.

DETAILED DESCRIPTION

Figure 1:
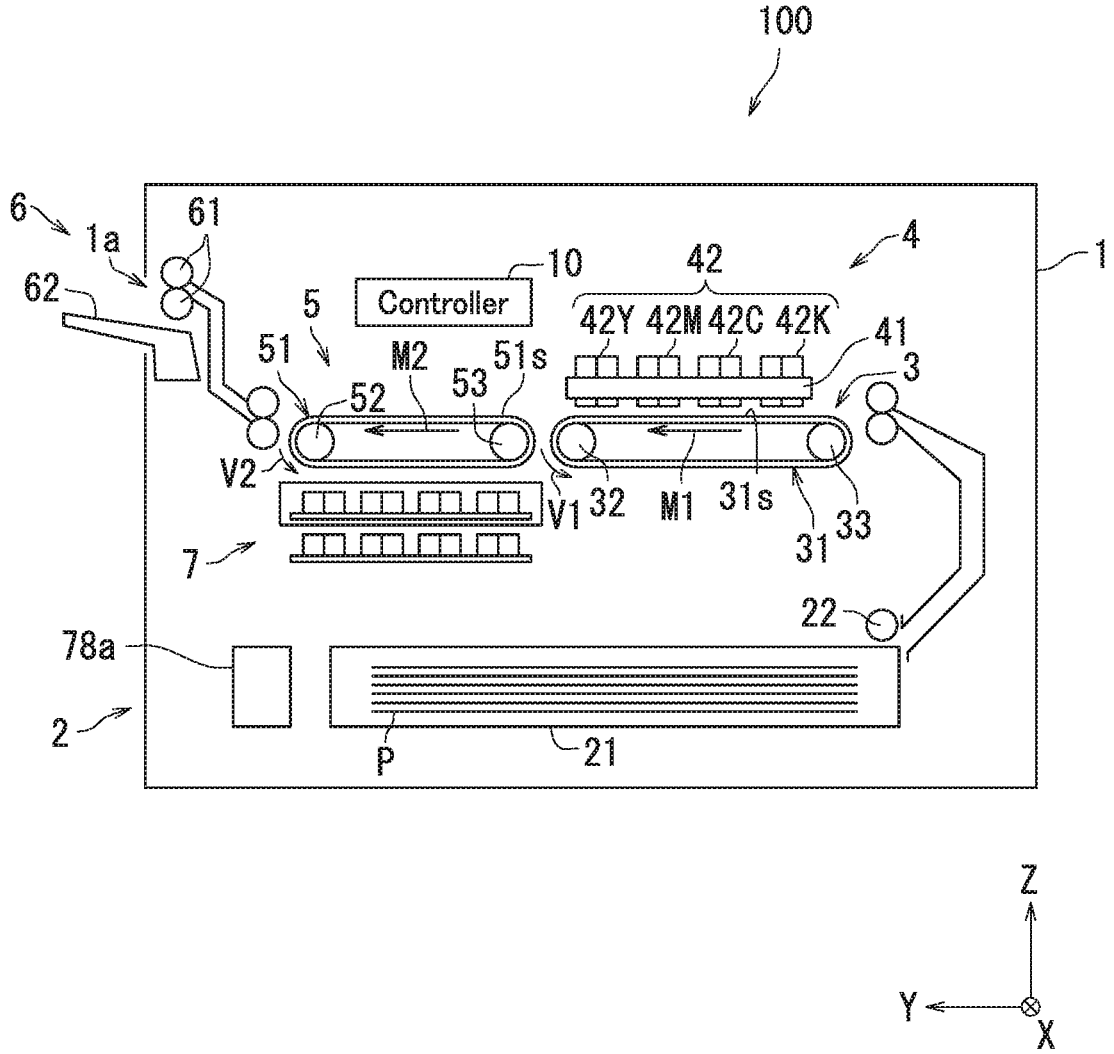
FIG. 1 shows a configuration of an inkjet recording apparatus according to an embodiment of the present disclosure.

Hereinafter, an embodiment of an inkjet recording apparatus according to the present disclosure will be described with reference to the attached drawings. In the drawings and the embodiment, a component that is the same as, or corresponding to, a component described before bears the same reference sign thereto and will not be described in repetition. In the embodiment of the present disclosure, an X axis, a Y axis, and a Z axis perpendicular to one another are illustrated in the drawings. The Z axis is parallel to a vertical plane, and the X axis and the Y axis are parallel to a horizontal plane. In the embodiment, a positive side of the Z axis is a top side of an inkjet recording apparatus 100, and the opposite side thereto is a bottom side of the inkjet recording apparatus 100. A positive side of the X axis is a front side of the inkjet recording apparatus 100, and the opposite side thereto is a rear side of the inkjet recording apparatus 100. A positive side of the Y axis is a left side of the inkjet recording apparatus 100, and the opposite side thereto is a right side of the inkjet recording apparatus 100.

First, a configuration of the inkjet recording apparatus 100 according to an embodiment of the present disclosure will be described with reference to FIG. 1. FIG. 1 shows a configuration of the inkjet recording apparatus 100 according to this embodiment.

As illustrated in FIG. 1, the inkjet recording apparatus 100 includes a main body housing 1, a sheet feeding mechanism 2, a first conveyance mechanism 3, a recording section 4, a second conveyance mechanism 5, an discharge mechanism 6, a maintenance mechanism 7, and a controller 10.

The sheet feeding mechanism 2 includes a sheet feeding cassette 21 and a sheet feeding roller 22. The sheet feeding cassette 21 accommodates sheets P. The sheet feeding roller 22 feeds the sheets P accommodated in the sheet feeding cassette 21 one at a time. Such a sheet P fed from the sheet feeding cassette 21 is conveyed to the first conveyance mechanism 3.

The first conveyance mechanism 3 conveys the sheet P in a first conveying direction M1. This will be described in more detail. The first conveyance mechanism 3 includes a first conveyor belt 31, a first driving roller 32, and a first subordinate roller 33. The first conveyor belt 31 is an endless belt, and is wound along the first driving roller 32 and the first subordinate roller 33. The first driving roller 32 is driven by a motor to rotate counterclockwise in FIG 1. As a result, the first conveyor belt 31 runs in a first running direction V1.

The first conveyor belt 31 has a first placement surface 31*s*. The first placement surface 31*s* is a part of the outer circumferential surface of the first conveyor belt 31 on which the sheet P is to be placed. The first conveyor belt 31 runs in the first running direction V1, and as a result, the sheet P placed on the first placement surface 31*s* is conveyed in the first conveying direction M1.

The recording section 4 is located opposite to the first placement surface 31*s* of the first conveyor belt 31. The recording section 4 ejects ink to perform an image forming process of forming an image on the sheet P. The recording section 4 also performs a maintenance process under a predetermined condition. The maintenance process includes, for example, a purging process of ejecting ink.

The recording section 4 includes a head housing 41 and four line heads 42. The head housing 41 supports the four line heads 42. The four line heads 42 respectively eject yellow ink, magenta ink, cyan ink, and black ink. Hereinafter, the line head 42 ejecting the yellow ink may be referred to as a "line head 42Y", the line head 42 ejecting the magenta ink may be referred to as a "line head 42M", the line head 42 ejecting the cyan ink may be referred to as a "line head 42C", and the line head 42 ejecting the black ink may be referred to as a "line head 42K". The line heads 42K, 42C, 42M, and 42Y are located in this order in the first conveying direction M1.

The sheet P on which an image has been formed by the recording section 4 is sent to the second conveyance mechanism 5.

The second conveyance mechanism 5 is located downstream in the first conveying direction M1 with respect to the first conveyance mechanism 3. The second conveyance mechanism 5 conveys the sheet P in a second conveying direction M2. This will be described in more detail. The second conveyance mechanism 5 includes a second conveyor belt 51, a second driving roller 52, and a second subordinate roller 53. The second conveyor belt 51 is an endless belt, and is wound along the second driving roller 52 and the second subordinate roller 53. The second driving roller 52 is driven by a motor to rotate counterclockwise in FIG. 1. As a result, the second conveyor belt 51 runs in a second running direction V2.

The second conveyor belt 51 includes a second placement surface 51*s*. The second placement surface 51*s* is a part of the outer circumferential surface of the second conveyor belt 51 on which the sheet P is to be placed. The second conveyor belt 51 runs in the second running direction V2, and as a result, the sheet P placed on the second placement surface 51*s* is conveyed in the second conveying direction M2. The sheet P conveyed in the second conveying direction M2 is sent to the discharge mechanism 6. In this embodiment, the first conveying direction M1 and the second conveying direction M2 are directions from the negative side to the positive side of the Y axis.

The discharge mechanism 6 discharges the sheet P out of the main body housing 1. The discharge mechanism 6 includes a pair of discharging rollers 61 and a discharge tray 62. The pair of discharging rollers 61 rotate to discharge the sheet P out the main body housing 1 via a discharging opening 1*a*. The discharging opening 1*a* is formed in a side surface of the main body housing 1. The sheet P discharged out of the main body housing 1 is placed on the discharge tray 62.

The maintenance mechanism 7 performs the maintenance process on each of the line heads 42.

The controller 10 includes a processor such as a central processing unit (CPU). The controller 10 includes an integrated circuit for the image forming process. The integrated circuit for the image forming process includes, for example, an application specific integrated circuit (ASIC). The controller 10 includes a storage region. The controller 10 executes a control program stored on the storage region to control operation of each of elements of the inkjet recording apparatus 100. The controller 10 controls operation of, for example, the maintenance mechanism 7.

Figure 2:
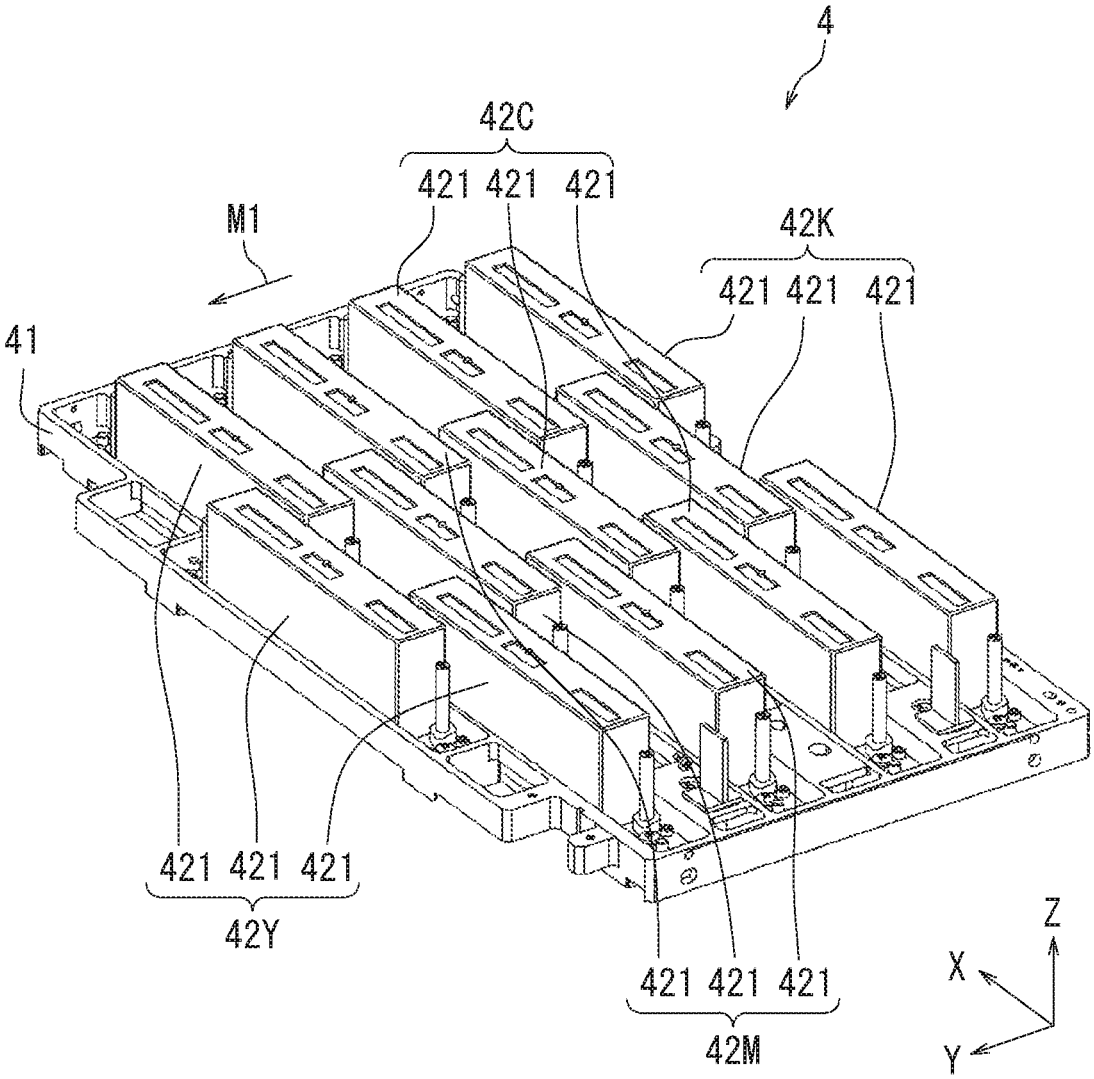
FIG. 2 shows a configuration of a recording section according to an embodiment of the present disclosure.
Figure 3:
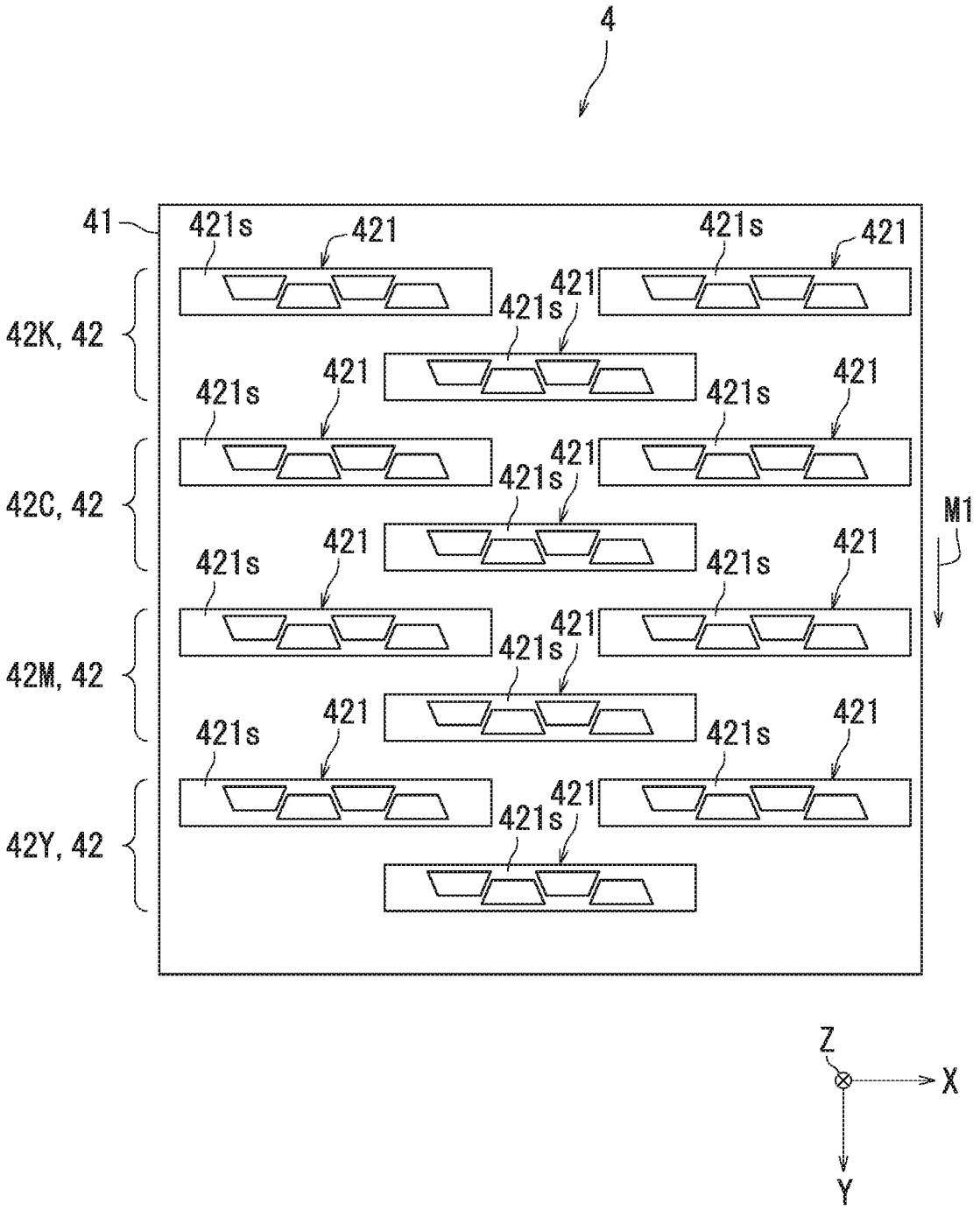
FIG. 3 shows a configuration of the recording section according to an embodiment of the present disclosure.

Now, with reference to FIG. 2 and FIG. 3, a configuration of the recording section 4 according to this embodiment will be described. FIG. 2 and FIG. 3 each illustrate the configuration of the recording section 4 according to this embodiment. FIG. 2 illustrates the recording section 4 as seen obliquely from above, and FIG. 3 illustrates the recording section 4 as seen from below (from the side of the first conveyance mechanism 3).

As illustrated in FIG. 2, the line heads 42Y through 42K each include three recording heads 421. The three recording heads 421 are located in an X direction.

As illustrated in FIG. 3, each of the recording heads 421 includes a nozzle surface 421*s* in which a plurality of nozzles are formed. The nozzle surface 421*s* faces the first placement surface 31*s* of the first conveyor belt 31 described above with reference to FIG. 1. In the above configuration, ink is ejected from the plurality of nozzles, and as a result, an image is formed on the sheet P placed on the first placement surface 31*s*.

Figure 4:
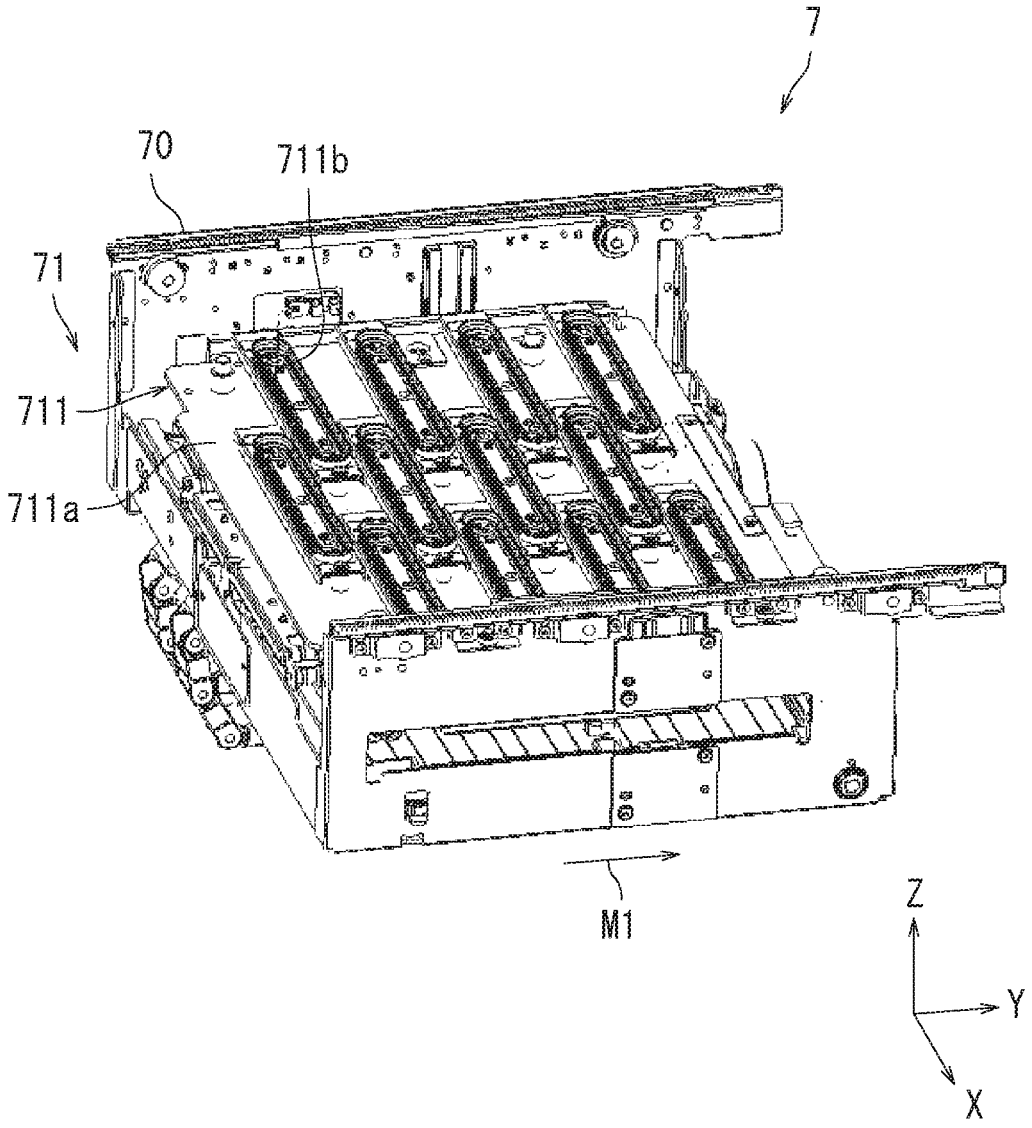
FIG. 4 shows a configuration of a maintenance mechanism according to an embodiment of the present disclosure.

Now, with reference to FIGS. 4-6, a configuration of the maintenance mechanism 7 according to this embodiment will be described. FIG. 4 shows the configuration of the maintenance mechanism 7 according to this embodiment.

As illustrated in FIG. 4, the maintenance mechanism 7 includes a driving section, a carriage 70, and a maintenance section 71. The driving section includes a carriage driving section, a cap driving section, and a wiper driving section.

The carriage 70 is movable in a horizontal direction. More specifically, the carriage 70 is driven by the carriage driving section to move in the horizontal direction between an area below the second conveyance mechanism 5 described above with reference to FIG. 1 and an area below the recording section 4 also described above with reference to FIG. 1.

The maintenance section 71 includes a cap unit 711. The cap unit 711 is movable in the horizontal direction and an up-down direction. The maintenance section 71 is driven by the cap driving section to move in the horizontal direction or the up-down direction. The cap unit 711 is moved in the horizontal direction between an area below the second conveyance mechanism 5 and an area below the recording section 4.

The cap unit 711 includes a cap tray 711*a* and 12 cap sections 711*b*. The number of the cap sections 711*b* matches the number of the recording heads 421.

The cap tray 711*a* is a flat plate-like member. The cap sections 711*b* are placed on the cap tray 711*a*. The cap sections 711*b* are placed at positions in correspondence with the recording heads 421. With such a configuration, the cap unit 711 is moved upward at a location opposite to the recording section 4, and as a result, the nozzle surfaces 421*s* of the recording heads 421 are capped. In this manner, ink is inhibited from drying.

Figure 5:
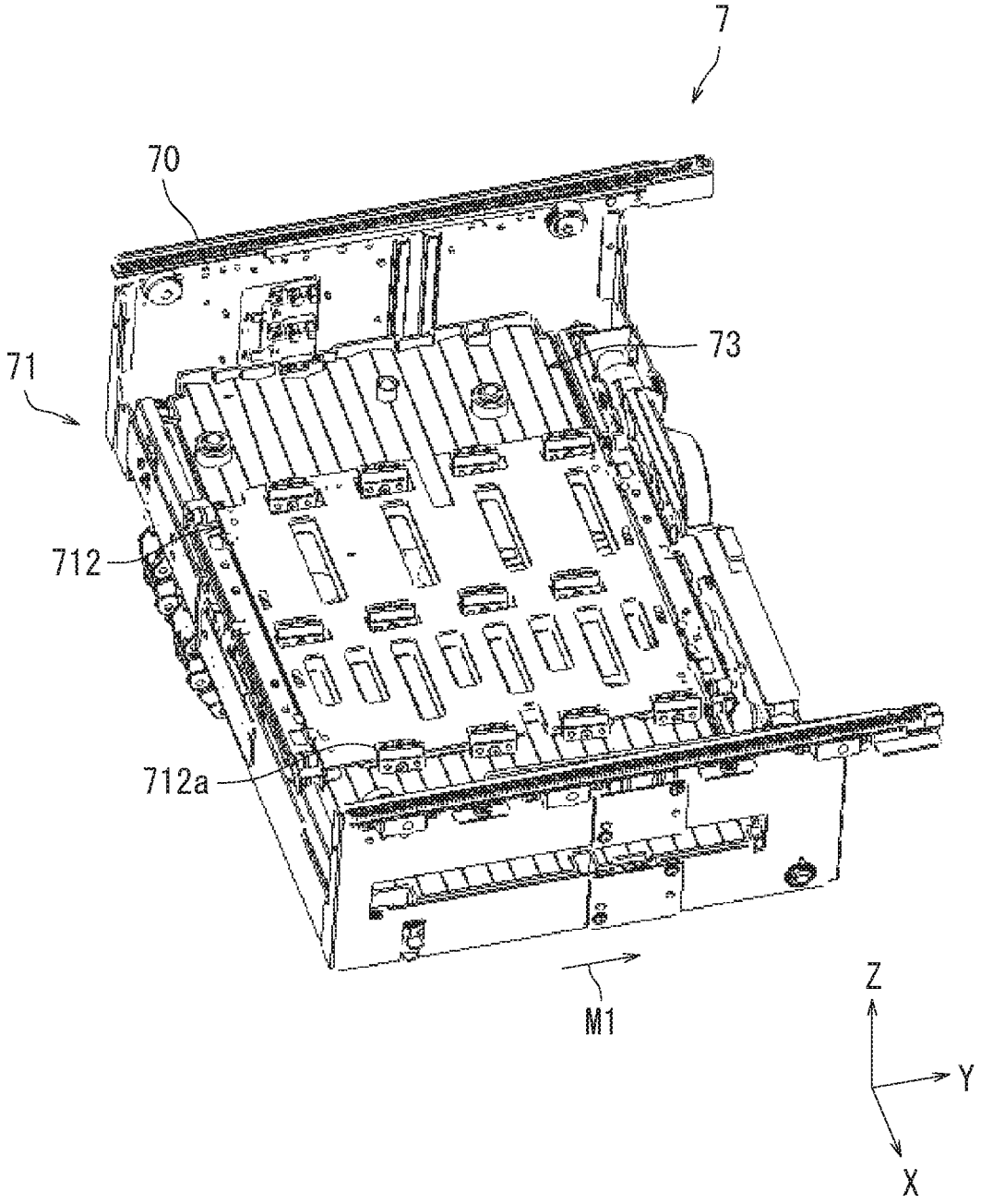
FIG. 5 shows a configuration of the maintenance mechanism according to an embodiment of the present disclosure.

FIG. 5 shows the configuration of the maintenance mechanism 7 according to this embodiment. More specifically, FIG. 5 shows the maintenance mechanism 7 in a state in which the cap unit 711 illustrated in FIG. 4 is removed.

As illustrated in FIG. 5, the maintenance section 71 further includes a wiping unit 712. The wiping unit 712 includes 12 wipers 712*a*. The wipers 712*a* are provided in correspondence with the recording heads 421. The wipers 712*a* each perform a wiping process. In more detail, the wipers 712*a* are each driven by the wiper driving section to move in a predetermined direction along a corresponding one of the nozzle surfaces 421*a* (see FIG. 3). As a result, foreign matter attached to the nozzle surfaces 421*a* is wiped out, and the nozzle surfaces 421*a* are cleaned.

Figure 6:
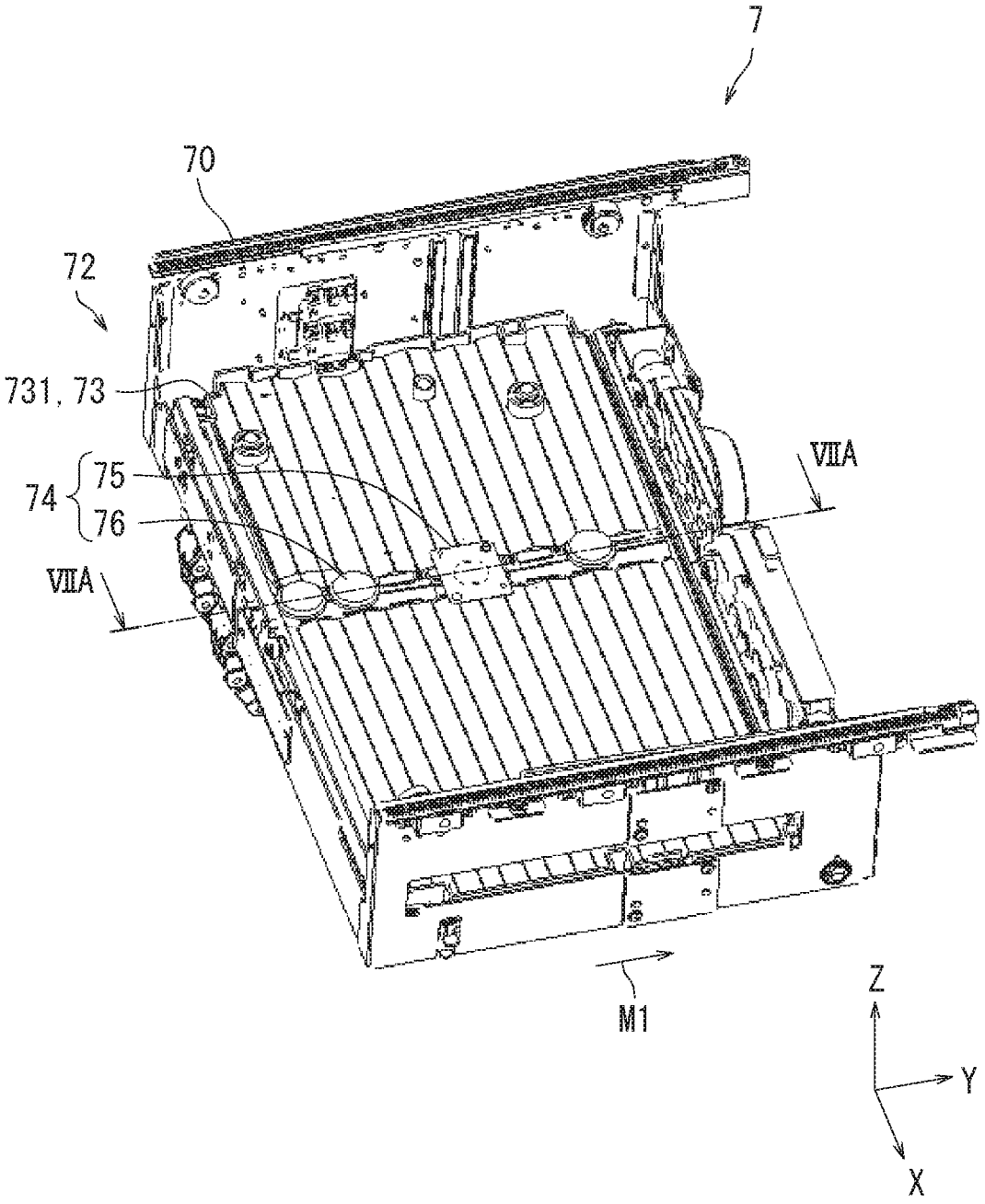
FIG. 6 shows a configuration of the maintenance mechanism according to an embodiment of the present disclosure.

FIG. 6 shows a configuration of the maintenance mechanism 7 according to this embodiment. More specifically, FIG. 6 shows the maintenance mechanism 7 in a state in which the wiping unit 712 illustrated in FIG. 5 is removed.

Figure 11:
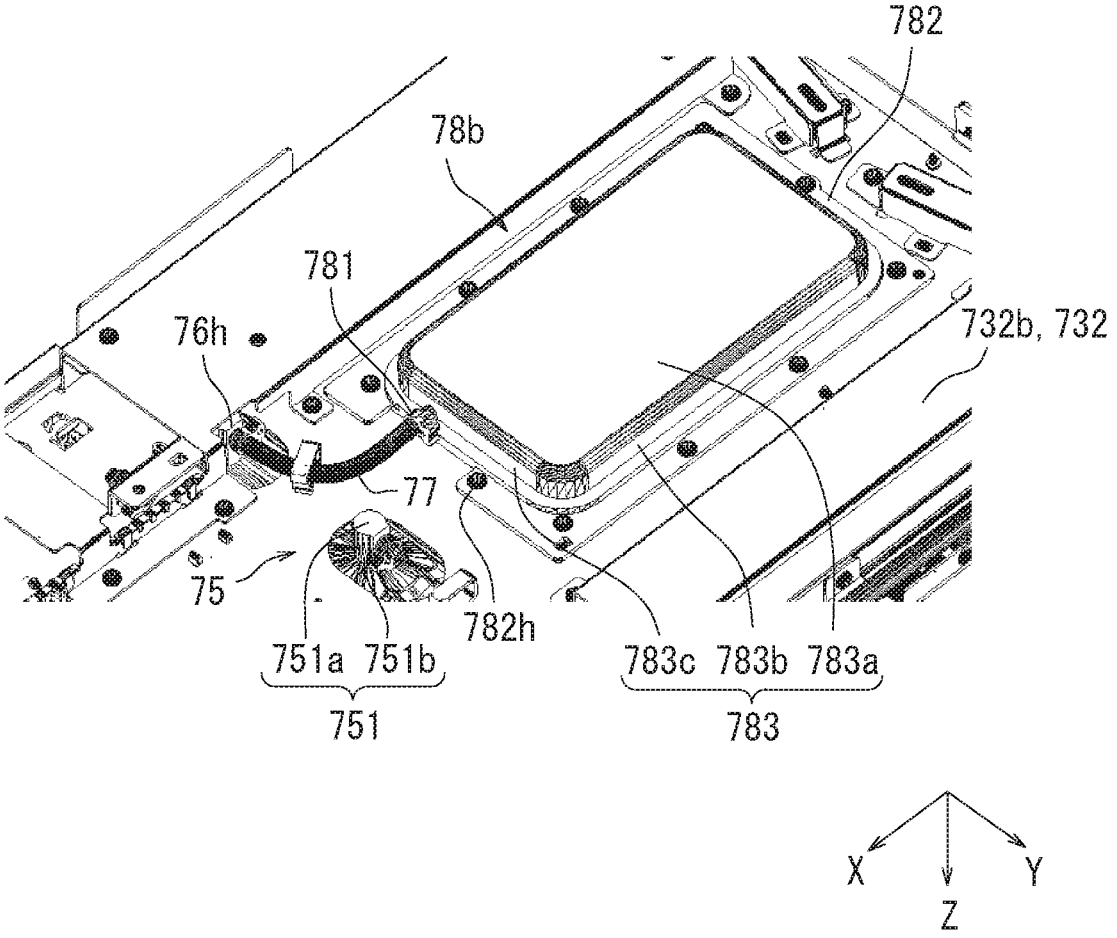
FIG. 11 shows a configuration of a second waste tank according to an embodiment of the present disclosure.

As illustrated in FIG. 6 and also FIG. 11, the maintenance mechanism 7 further includes an ink recovery section 72. The ink recovery section 72 includes a tray section 73, an ink inflow section 74, a first waste tank 78*a*, and a second waste tank 78*b*.

The tray section 73 includes a waste ink tray 731. The waste ink tray 731 receives (recovers) ink dropping from the recording heads 421. The waste ink tray 731 recovers the ink dropping as a result of, for example, the wipers 712*a*, described above with reference to FIG. 5, wiping the recording heads 421 in the wiping process.

The ink inflow section 74 includes a first inflow section 75 and a second inflow section 76. The ink recovered in the waste ink tray 731 flows into the first inflow section 75 and the second inflow section 76. The ink flowing into the first inflow section 75 and the second inflow section 76 are retained in the first waste tank 78*a* and the second waste tank 78*b*. More specifically, the ink flowing from the first inflow section 75 is retained in the first waste tank 78*a*, and the ink flowing from the second inflow section 76 is retained in the second waste tank 78*b*.

The first inflow section 75 and the second inflow section 76 are located at a substantial center of the waste ink tray 731 in the X direction. The first inflow section 75 is located at a substantial center of the waste ink tray 731 in a Y direction. The second inflow section 76 is located at a position different from a substantial center of the waste ink tray 731 in the Y direction. In this embodiment, the second inflow section 76 is located upstream in the first conveying direction M1 (negative side of the Y axis with respect to the first inflow section 75.

Figure 7A:
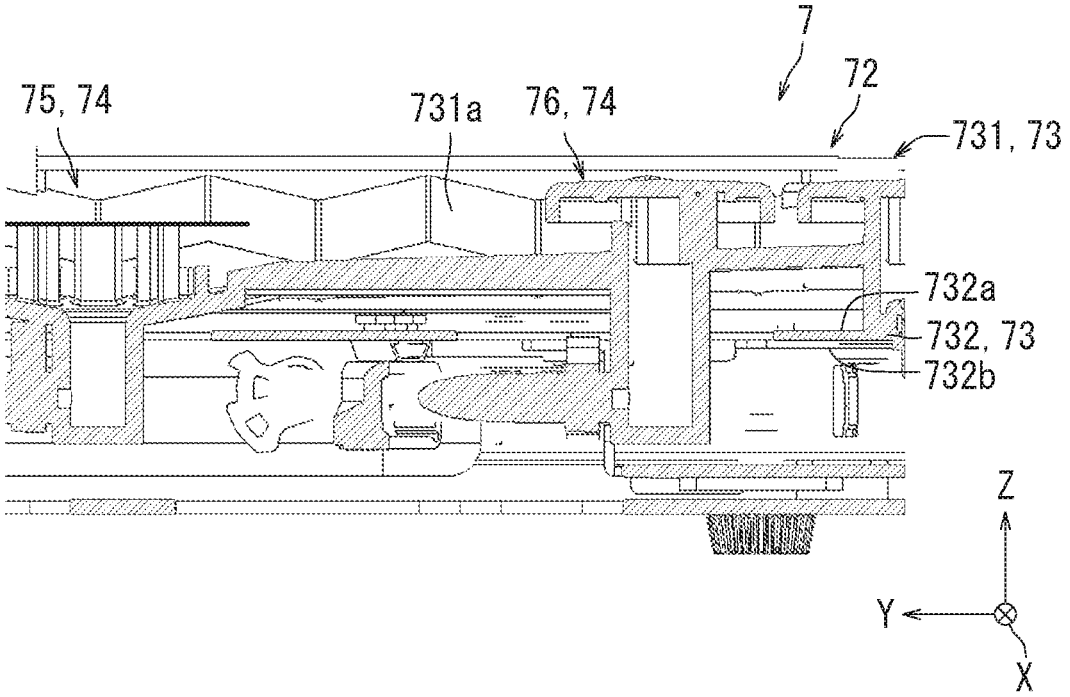
FIG. 7A and FIG. 7B each show a configuration of an ink recovery section according to an embodiment of the present disclosure.
Figure 7B:
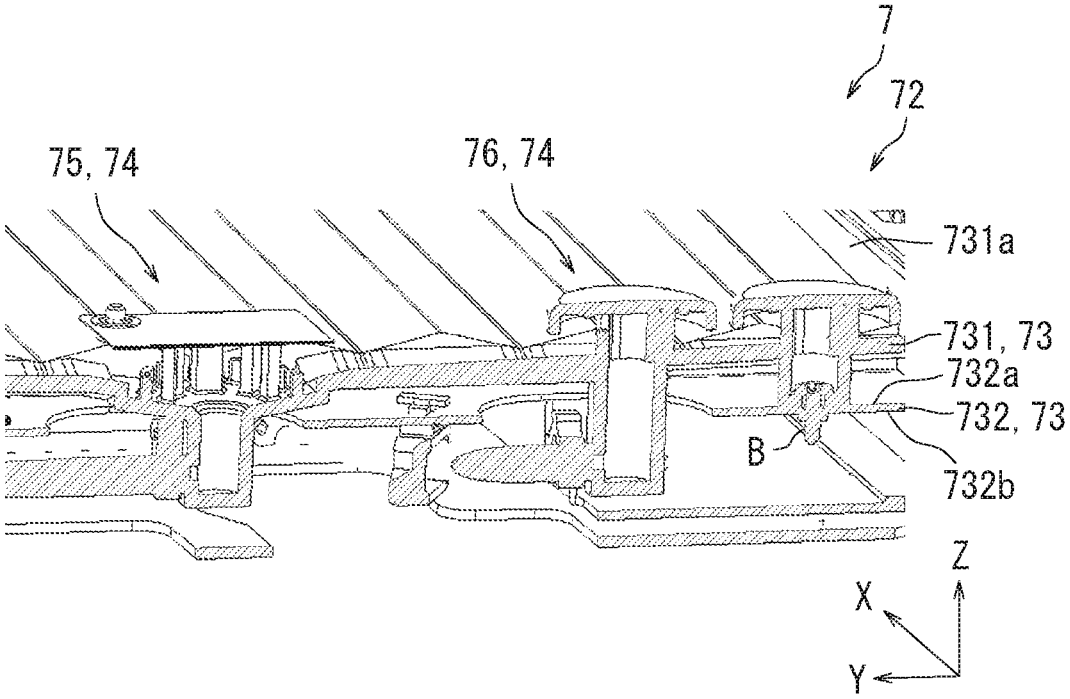

Now, with reference to FIGS. 7A-9B, a configuration of the ink recovery section 72 according to this embodiment will be described. FIG. 7A and FIG. 7B each show the configuration of the ink recovery section 72 according to this embodiment FIG. 7A illustrates a cross-section taken along line VIIA-VIIA in FIG. 6.

As illustrated in FIG. 7A and FIG. 7B, the waste ink tray 731 includes a top surface 731*a*. The top surface 731*a* has a downward slope extending toward the first inflow section 75. In other words, the first inflow section 75 is located at the lowest position of the top surface 731*a* of the waste ink tray 731. The top surface 731*a* is an example of a slope.

The tray section 73 further includes a coupling plate 732. The coupling plate 732 is a flat plate-like member. The coupling plate 732 is attached to the carriage 70.

The waste ink tray 731 is fastened to the coupling plate 732 by a fastening member B such as a screw. The coupling plate 732 and the waste ink tray 731 are accordingly coupled to each other. In the above configuration, when the carriage 70 moves, the waste ink tray 731 also moves together with the coupling plate 732.

The coupling plate 732 includes a first plate surface 732*a* and a second plate surface 732*b*. The first plate surface 732*a* is one of two main surfaces of the coupling plate 732 that faces a bottom surface of the waste ink tray 731. The second plate surface 732*b* is the other main surface opposite to the first plate surface 732*a*.

Figure 8A:
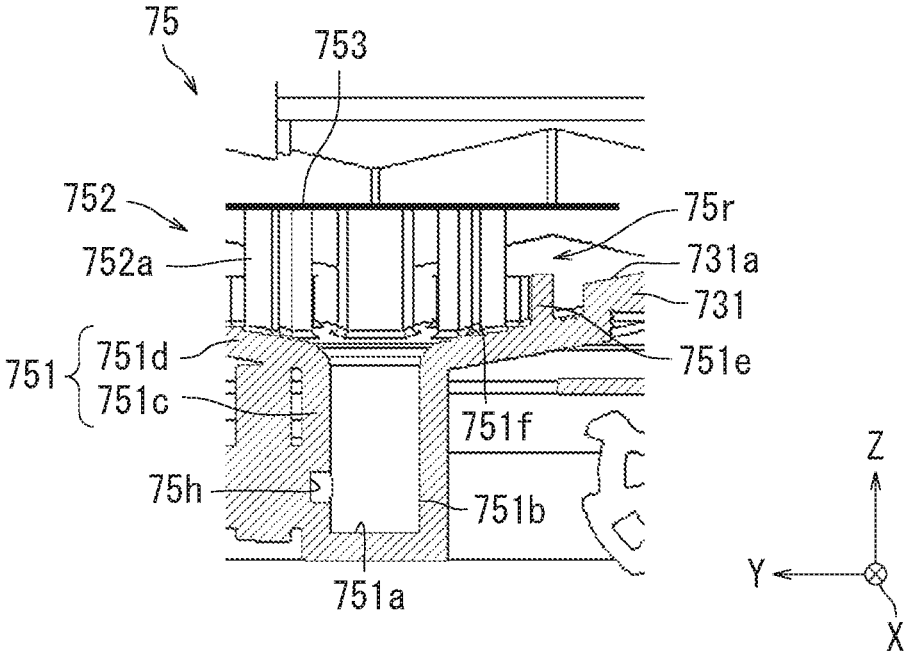
FIG 8A and FIG. 8B each show a configuration of a first inflow section according to an embodiment of the present disclosure.
Figure 8B:
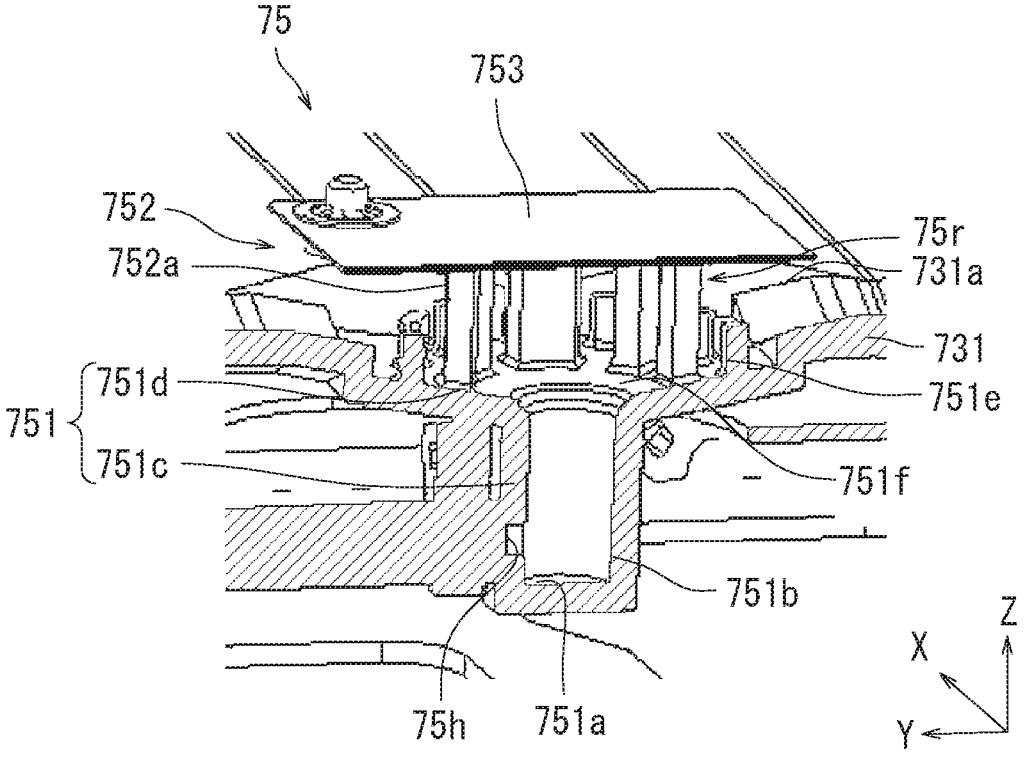

Now, with reference to FIG 8A and FIG 8B, a configuration of the first inflow section 75 according to this embodiment will be described. FIG. 8A and FIG 8B each illustrate the configuration of the first inflow section 75 according to this embodiment. More specifically, FIG. 8A is an enlarged view illustrating the first inflow section 75 illustrated in FIG. 7A and the vicinity thereof, and FIG. 8B is an enlarged view illustrating the first inflow section 75 illustrated in FIG. 7B and the vicinity thereof.

As illustrated in FIG. 8A and FIG. 8B, the first inflow section 75 includes a first cylindrical section 751, a top plate supporting section 752, a top plate section 753, a first inflow opening 75*r*, and a first discharge opening 75*h*.

The first cylindrical section 751 protrudes downward from the top surface 731*a*. The first cylindrical section 751 includes a small-diameter section 751*c* and a large-diameter section 751*d*. The small-diameter section 751*c* and the large-diameter section 751*d* are circular as seen in a plan view, and are concentric with each other.

The large-diameter section 751*d* includes a second side wall 751*e* and a second bottom wall 751*f*. The second side wall 751*e* extends downward from the top surface 731*a* of the waste ink tray 731. The second bottom wall 751*f* is connected with a bottom end of the second side wall 751*e*. The second bottom wall 751*f* has a downward slope extending toward the center thereof. More specifically, the second bottom wall 751*f* has a downward slope extending toward the small-diameter section 751*c*.

The small-diameter section 751*c* includes a first bottom wall 751*a* and a first side section 751*b*. The first side section 751*b* extends downward from the second bottom wall 751*f* A bottom end of the first side section 751*b* is connected with the first bottom wall 751*a*.

The top plate supporting section 752 includes a plurality of supporting columns 752*a*. The supporting columns 752*a* extend upward from the second bottom wall 751*f*. The supporting columns 752*a* each have a top end connected with a bottom surface of the top plate section 753 and thus support the top plate section 753.

The top plate section 753 is a plate-like member that is substantially rectangular as seen in a plan view. The top plate section 753 includes a top surface. The top surface of the top plate section 753 has a size larger than a diameter of the large-diameter section 751*d*. The top plate section 753 accordingly covers the large-diameter section 751*d*.

The first inflow opening 75*r* is constituted by the top plate section 753 and the second side wall 751*e*. The first discharge opening 75*h* is formed in a bottom portion of the first side section 751*b*. The first discharge opening 75*h* is in communication with the first waste tank 78*a*.

Figure 9A:
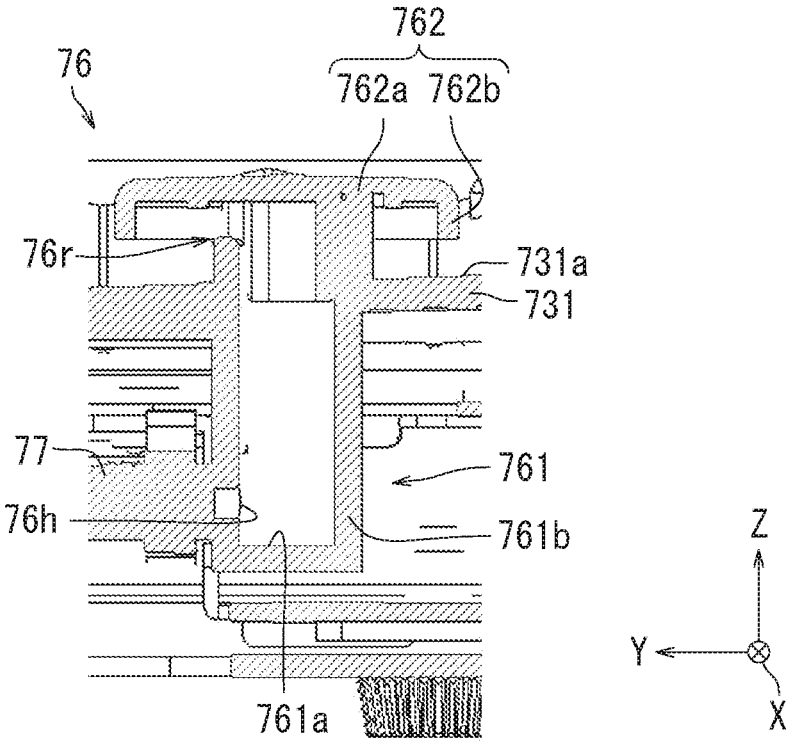
FIG. 9A and FIG. 9B each show a configuration of a second inflow section according to an embodiment of the present disclosure.
Figure 9B:
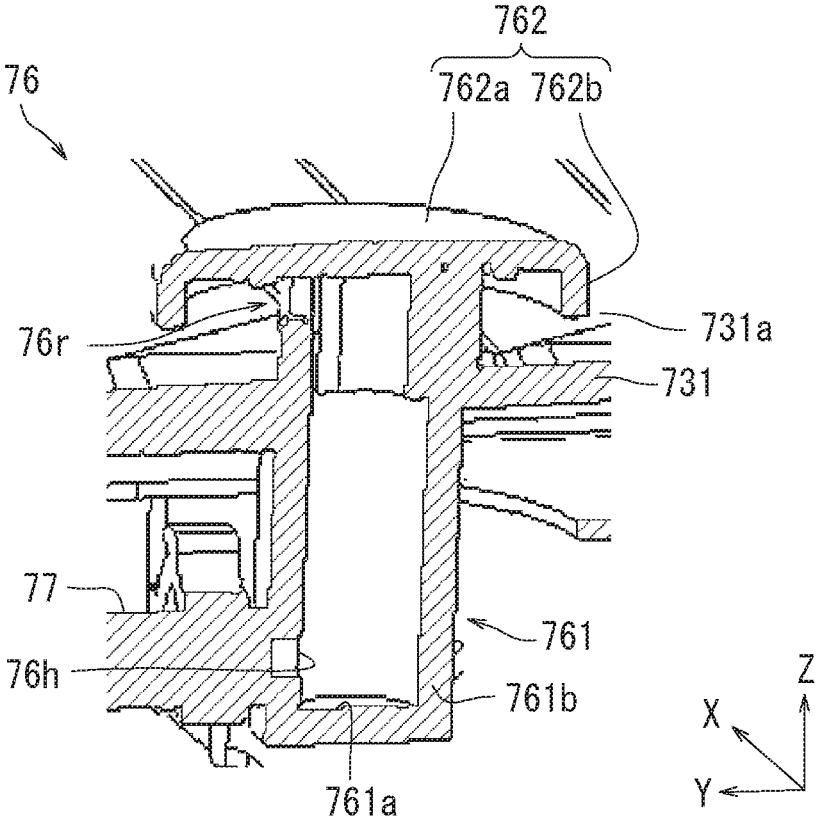

Now, with reference to FIG. 9A and FIG. 9B, a configuration of the second inflow section 76 according to this embodiment will be described. FIG. 9A and FIG. 9B each illustrate the configuration of the second inflow section 76 according to this embodiment. More specifically, FIG. 9A is an enlarged view illustrating the second inflow section 76 illustrated in FIG: 7A and the vicinity thereof, and FIG. 9B is an enlarged view illustrating the second inflow section 76 illustrated in FIG. 7B and the vicinity thereof.

As illustrated in FIG. 9A and FIG. 9B, the second inflow section 76 includes a second cylindrical section 761, an umbrella section 762, a second inflow opening 76*r*, and a second discharge opening 76*h*.

The second cylindrical section 761 is circular as seen in a plan view. The second cylindrical section 761 includes a third bottom wall 761*a* and a third side wall 761*b*.

The third side wall 761*b* runs through the waste ink tray 731. A bottom end of the third side wall 761*b* is connected with the third bottom wall 761*a*. The third bottom wall 761*a* is accordingly located below the waste ink tray 731.

The umbrella section 762 is substantially circular as seen in a plan view. The umbrella section 762 includes a discus section 762*a* and a brim section 762*b*. The discus section 762*a* is connected with a top end of the third side wall 761*b*. The discus section 762*a* is circular as seen in a plan view, and is concentric with the second cylindrical section 761. The discus section 762*a* has a diameter longer than a diameter of the second cylindrical section 761. The umbrella section 762 accordingly covers a top portion of the second inflow opening 76*r*. The brim section 762*b* extends downward from the outer perimeter of the discus section 762*a*.

The second inflow opening 76*r* and the second discharge opening 76*h* are located in the third side wall 761*b*. More specifically, the second inflow opening 76*r* is located in a top portion of the third side wall 761*b*. The second discharge opening 76*h* is located in a bottom portion of the third side wall 761*b*. The second discharge opening 76*h* is located at a position below the top surface 731*a* of the waste ink tray 731 in the up-down direction.

The second discharge opening 76*h* is in communication with the second waste tank 78*b* via a tube 77 included in the ink recovery section 72.

Figure 10:
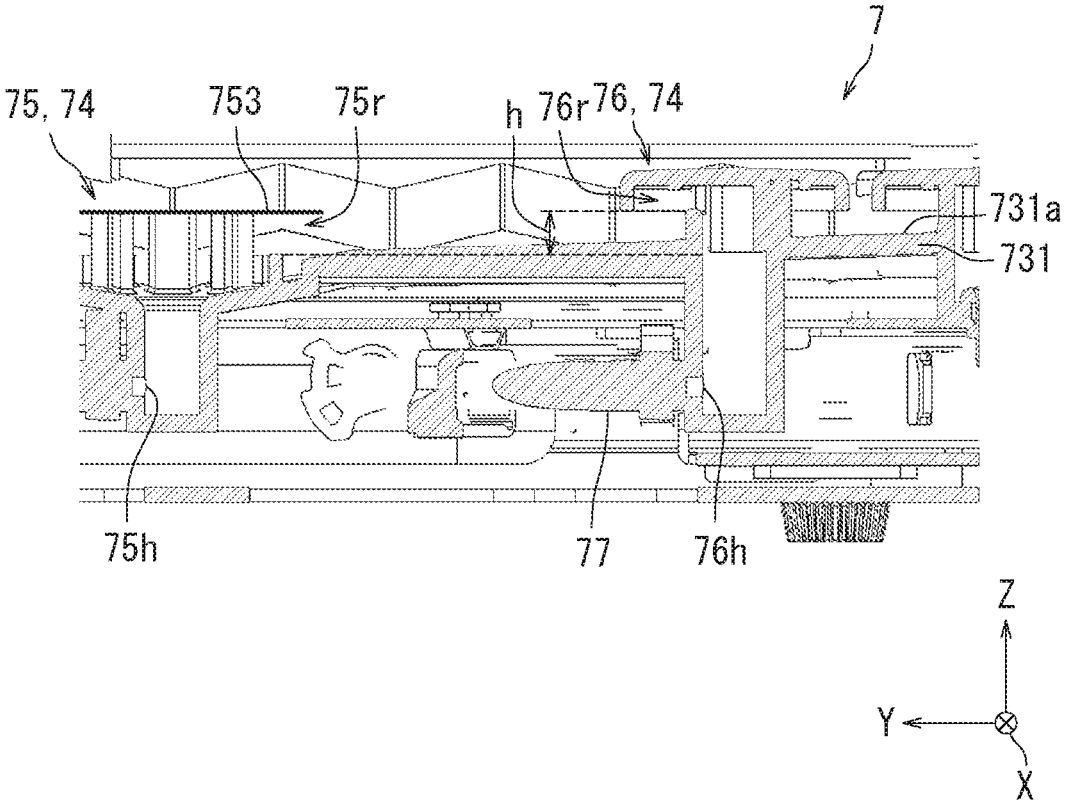
FIG. 10 shows a configuration of a first inflow opening and a second inflow opening according to an embodiment of the present disclosure.

Now, with reference to FIG. 10, a configuration of the first inflow opening 75*r* and the second inflow opening 76*r* according to this embodiment will be described. FIG. 10 shows the configuration of the first inflow opening 75*r* and the second inflow opening 76*r* according to this embodiment.

As illustrated in FIG. 10, the first inflow opening 75*r* is located at a position substantially matching the position of the top surface 731*a* of the waste ink tray 731 in the up-down direction. The second inflow opening 76*r* is located at a position above the position of the top surface 731*a* of the waste ink tray 731 in the up-down direction.

As described above with reference to FIG. 7A, the top surface 731*a* of the waste ink tray 731 has a downward slope extending toward the first inflow section 75. The position of the first inflow opening 75*r* in the up-down direction accordingly matches the lowest position of the top surface 731*a* of the waste ink tray 731. As described above with reference to FIG. 6, the second inflow section 76 is located upstream in the first conveying direction M1 with respect to the first inflow section 75. The position of the second inflow opening 76*r* in the up-down direction is accordingly located above the position of the first inflow opening 75*r* in the up-down direction.

In a state in which the first inflow opening 75*r* is not closed, the ink recovered to the top surface 731*a* of the waste ink tray 731 flows into the first inflow opening 75*r* via the top surface 731*a* of the waste ink tray 731. The ink flowing into the first inflow opening 75*r* flows to the first waste tank 78*a* via the first discharge opening 75*h*.

The first inflow opening 75*r* may be clogged by, for example, the ink coagulating and sticking thereto. When the first inflow opening 75*r* is clogged, the ink recovered to the top surface 731*a* of the waste ink tray 731 is retained on the top surface 731*a* of the waste ink tray 731.

The second inflow opening 76*r* is located above the first inflow opening 75*r*. In the above configuration, when the amount of the ink retained on the top surface 731*a* of the waste ink tray 731 exceeds a predetermined amount, a portion of the ink retained on the top surface 731*a* of the waste ink tray 731 flows into the second inflow opening 76*r*. The ink flowing into the second inflow opening 76*r* flows to the second waste tank 78*b* via the tube 77. Hereinafter, the amount of the ink retained on the top surface 731*a* of the waste ink tray 731 after the first inflow opening 75*r* is clogged until the ink flows into the second inflow opening 76*r* will be referred to as a "retention amount MA".

The retention amount MA is determined based on an inflow opening distance and a height difference h. The "inflow opening distance" is a distance between the first inflow opening 75*r* and the second inflow opening 76*r* in the Y direction (horizontal direction). The "height difference h" is a distance between the first inflow opening 75*r* and the second inflow opening 76*r* in a Z direction (vertical direction).

In this embodiment, the position of the second inflow opening 76*r* is set such that the retention amount MA is larger than a maximum ejection amount MP, which is a maximum amount of ink ejected by one ejecting operation by each recording head 421.

Now, with reference to FIG. 11, a configuration of the second waste tank 78*b* according to this embodiment will be described. FIG. 11 illustrates the configuration of the second waste tank 78*b* according to this embodiment. More specifically, FIG. 11 illustrates the coupling plate 732 described above with reference to FIG. 7A as seen from below.

As illustrated in FIG. 11, the second waste tank 78*b* includes a tank inflow opening 781, a coupling section 782, and an accommodating section 783.

The tank inflow opening 781 is in communication with the tube 77. In other words, the tank inflow opening 781 is in communication with the second discharge opening 76*h* via the tube 77.

The coupling section 782 is a flat plate-like member. The coupling section 782 is provided around the accommodating section 783. A plurality of fastening holes 782*h* are located in the coupling section 782. In a configuration in which the coupling section 782 is located parallel to the coupling plate 732 and a plurality of the fastening members B (see FIG. 12) are respectively fastened to the fastening holes 782*h*, the second waste tank 78*b* is secured to the second plate surface 732*b* of the coupling plate 732.

The accommodating section 783 accommodates the ink flowing thereto from the tank inflow opening 781 via the tube 77. The accommodating section 783 protrudes downward from the coupling section 782.

The accommodating section 783 includes an accommodation bottom wall 783*a*, a first accommodation side wall 783*b*, and a second accommodation side wall 783*c*. The accommodation bottom wall 783*a* is parallel to the coupling section 782. The first accommodation side wall 783*b* and the second accommodation side wall 783*c* extend upward from the accommodation bottom wall 783*a* and are connected with the coupling section 782. The tank inflow opening 781 is located in the second accommodation side wall 783*c*.

Figure 12:
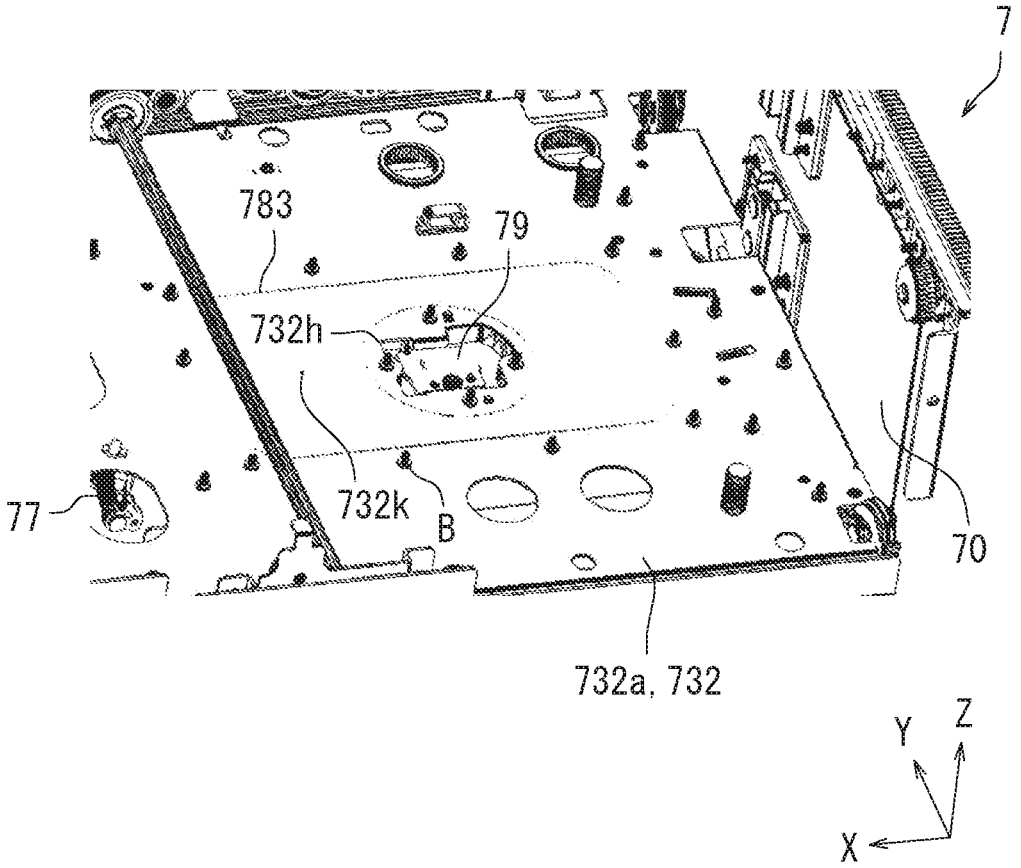
FIG. 12 shows a configuration of a coupling plate according to an embodiment of the present disclosure.

Now, with reference to FIG. 12, a configuration of the coupling plate 732 according to this embodiment will be described. FIG. 2 illustrates the configuration of the coupling plate 732 according to this embodiment. More specifically, FIG. 12 illustrates the coupling plate 732 as seen from above. In other words, FIG. 12 illustrates the coupling plate 732 in FIG. 11 seen from the opposite side.

As illustrated in FIG. 12, the coupling plate 732 includes a ventilation hole 732*k* and a plate opening 732*h*. The ventilation hole 732*k* and the plate opening 732*h* run through the coupling plate 732. The ventilation hole 732*k* allows air to pass therethrough.

The maintenance mechanism 7 further includes an ink detecting section 79. The ink detecting section 79 outputs a detection signal indicating whether there is ink or not. More specifically, the ink detecting section 79 detects whether or not the ink has flown into the second inflow opening 76*r*. The ink detecting section 79 is exposed outside via the plate opening 732*h*.

Figure 13:
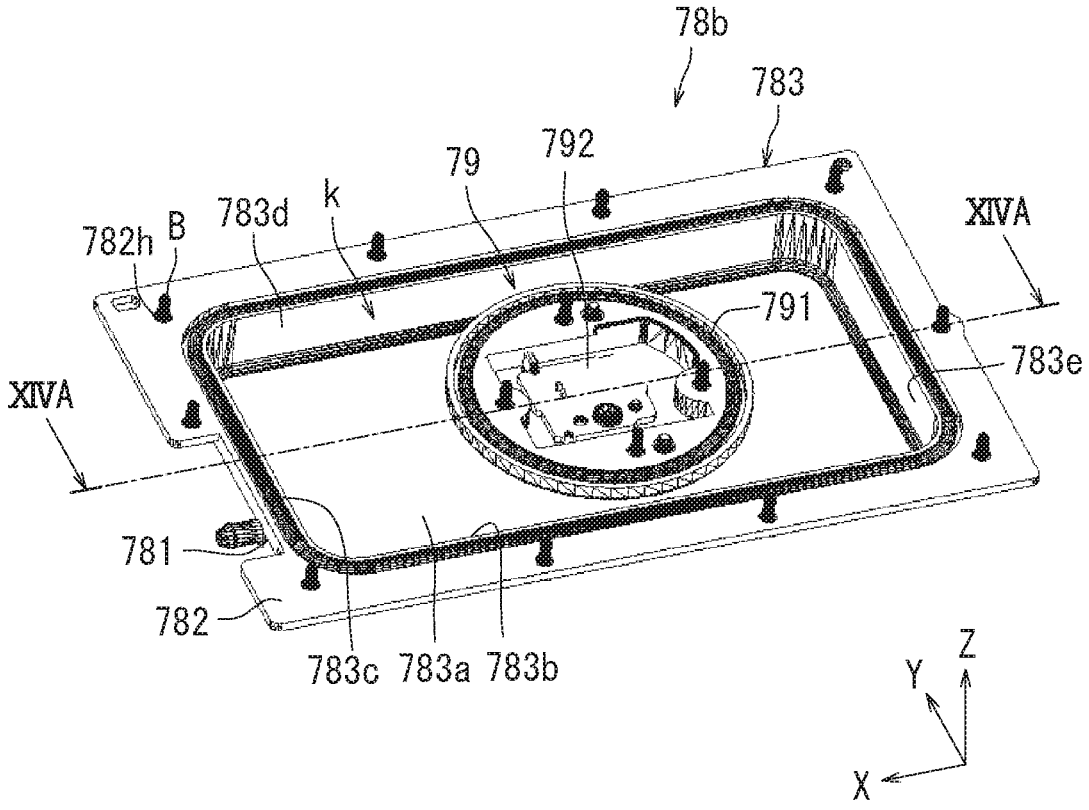
FIG. 13 shows a configuration of the second waste tank and an ink detecting section according to an embodiment of the present disclosure.

Now, with reference to FIG. 13, a configuration of the second waste tank 78*b* and the ink detecting section 79 will be described. FIG. 13 shows the configuration of the second waste tank 78*b* and the ink detecting section 79 according to this embodiment.

As illustrated in FIG. 13, the accommodating section 783 includes a third accommodation side wall 783*d* and a fourth accommodation side wall 783*e* in addition to the accommodation bottom wall 783*a*, the first accommodation side wall 783*b*, and the second accommodation side wall 783*c*. The third accommodation side wall 783*d* and the fourth accommodation side wall 783*e* extend upward from the accommodation bottom wall 783*a* and are connected with the coupling section 782.

The accommodation bottom wall 783*a*, the first accommodation side wall 783*b*, the second accommodation side wall 783*c*, third accommodation side wall 783*d*, and the fourth accommodation side wall 783*e* define an ink accommodating space K.

The coupling plate 732 covers the ink accommodating space k described above with reference to FIG. 12. A part of the coupling plate 732 that covers the ink accommodating space k constitutes a top surface of the accommodating section 783. In other words, the ventilation hole 732*k* described above with reference to FIG. 12 is located in the top surface of the accommodating section 783.

Figure 14A:
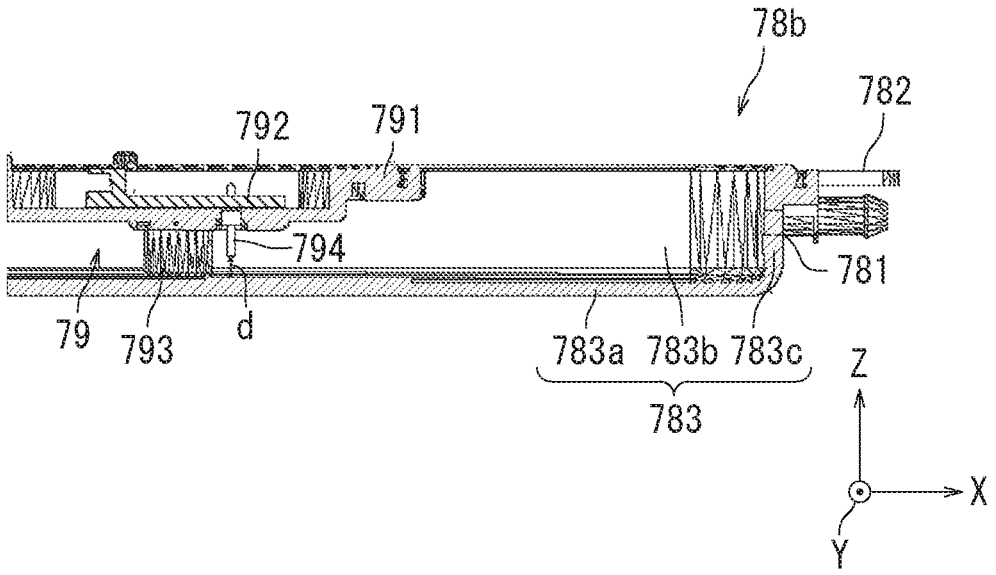
FIG. 14A and FIG. 14B each show a configuration of the ink detecting section according to an embodiment of the present disclosure.
Figure 14B:
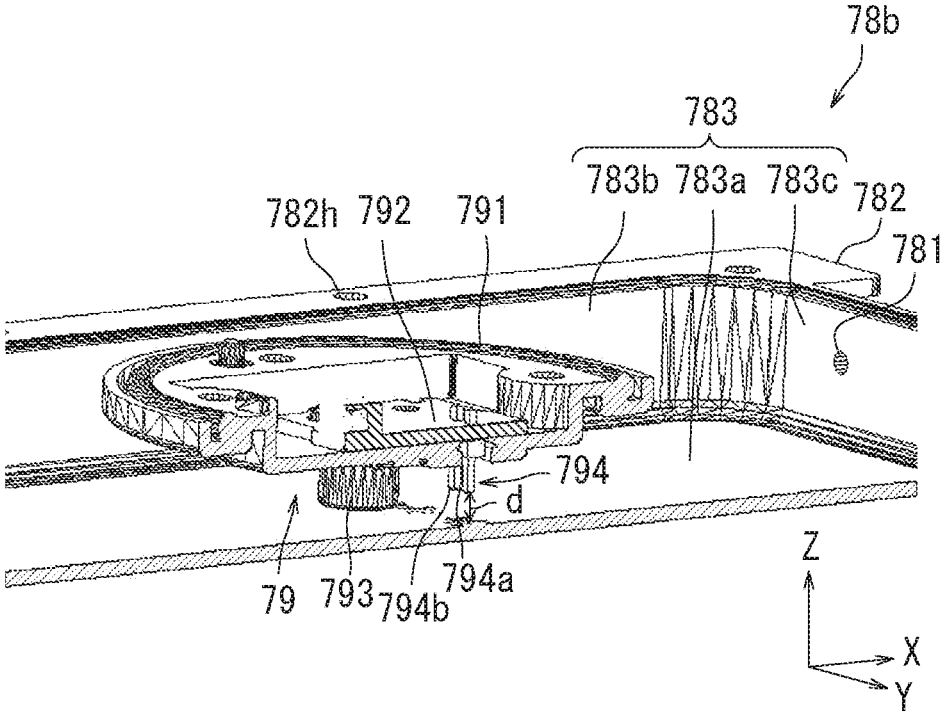

Now, with reference to FIG. 13, FIG. 14A, and FIG. 14B, a configuration of the ink detecting section 79 according to this embodiment will be described. FIG. 14A and FIG. 14B each illustrate the configuration of the ink detecting section 79 according to this embodiment. More specifically, FIG. 14A illustrates a cross-section taken along line XIVA-XIVA in FIG. 13, and FIG. 14B is a perspective cross-sectional view illustrating the ink detecting section 79 illustrated in FIG. 14A and the vicinity thereof.

As illustrated in FIG. 13, the ink detecting section 79 includes a board supporting section 791 and a circuit board 792. The board supporting section 791 is a flat plate-like member that is substantially circular as seen in a plan view The board supporting section 791 is located in the ink accommodating space k. The board supporting section 791 supports the circuit board 792.

As illustrated in FIG. 14A and FIG. 14B, the ink detecting section 79 further includes a supporting column section 793 and an ink detecting body 794. The supporting column section 793 protrudes upward from the accommodation bottom wall 783*a*. The supporting column section 793 has a top end connected with the board supporting section 791. The supporting column section 793 supports the board supporting section 791 from below.

As illustrated in FIG. 14B, the ink detecting body 794 includes a first ink detecting body 794*a* and a second ink detecting body 794*b*. The first ink detecting body 794*a* and the second ink detecting body 794*b* are connected with the circuit board 792 and run through the board supporting section 791. The first ink detecting body 794*a* and the second ink detecting body 794*b* extend to predetermined positions from the circuit board 792 toward the accommodation bottom wall 783*a* (downward). More specifically, the first ink detecting body 794*a* and the second ink detecting body 794*b* extend to positions that is away from the accommodation bottom wall 783*a* by a predetermined distance d. When the height (liquid level) of the ink accommodated in the accommodating section 783 exceeds the predetermined distance d, the ink comes in contact with the first ink detecting body 794*a* and the second ink detecting body 794*b*. When the ink comes in contact therewith, the first ink detecting body 794*a* and the second ink detecting body 794*b* are electrically connected with each other. When the first ink detecting body 794*a* and the second ink detecting body 794*b* electrically connected with each other, the circuit board 792 transmits, to the controller 10, a detection signal indicating that the ink has been detected. As a result, the controller 10 detects that the ink accommodated in the accommodating section 783 has reached a predetermined liquid level. In other words, the controller 10 detects that the amount of the ink accommodated in the accommodating section 783 has reached a predetermined amount. Upon detecting that the amount of the ink accommodated in the accommodating section 783 has reached such a predetermined amount, the controller 10 detects that the first inflow opening 75*r* is clogged.

So far, this embodiment has been described. According to this embodiment, the controller 10 detects that the first inflow opening 75*r* is closed. Upon detecting that the first inflow opening 75*r* is clogged, the controller 10, for example, causes the recording heads 421 to stop ejecting the ink. In the above configuration, the ink is prevented from overflowing from the waste ink tray 731. Thus, the inkjet recording apparatus 100 is prevented from being contaminated with the ink recovered to the waste ink tray 731.

In this embodiment, the maintenance mechanism 7 includes the second waste tank 78*b*. The ink retained in the waste ink tray 731 as a result of the first inflow opening 75*r* being clogged flows into the second waste tank 78*b*. In the above configuration, the ink is prevented from overflowing from the waste ink tray 731.

In this embodiment, the second waste tank 78*b* is located on the coupling plate 732. The coupling plate 732 is coupled with the waste ink tray 731 and moves together with the carriage 70. In the above configuration, the distance between the second inflow opening 76*r* and the second waste tank 78*b* is shortened when compared to, for example a configuration in which the second waste tank 78*b* is located in the main body housing 1. Thus, a time until the ink is detected is shortened when compared to a configuration in which the second waste tank 78*b* is located in the main body housing 1. This shortens the time required after the first inflow opening 75*r* is clogged until the first inflow opening 75*r* is detected as being clogged.

In the case where, for example, the ink detecting body 794 is located on the top surface 731*a* of the waste ink tray 731, the ink detecting body 794 may undesirably detect ink dropping into the waste ink tray 731 even though the first inflow opening 75*r* is not clogged. According to this embodiment, the ink detecting body 794 is located in the second waste tank 78*b*. In the above configuration, erroneous detection of ink by the ink detecting body 794 is prevented.

According to this embodiment, the ventilation hole 732*k* is located in the top surface of the second waste tank 78*b*. This smooths the flow of the ink into the second waste tank 78*b*.

According to this embodiment, the umbrella section 762 covers the second inflow opening 76*r*. This prevents the ink dropping into the waste ink tray 731 from flowing into the second inflow opening 76*r*. As a result, it is accurately detected that the first inflow opening 75*r* is clogged.

According to this embodiment, the umbrella section 762 includes the discus section 762*a* and the brim section 762*b*. The brim section 762*b* extends downward from the outer perimeter of the discus section 762*a*. This can further prevent the ink dropping into the waste ink tray 731 from flowing into the second inflow opening 76*r*. As a result, it is more accurately detected that the first inflow opening 75*r* is clogged.

According to this embodiment, the position of the second inflow opening 76*r* in the up-down direction is higher than the position of the first inflow opening 75*r* in the up-down direction by the height difference h. The height difference h is determined based on the maximum ejection amount MP of the recording heads 421. In the above configuration, even when the recording head 421 ejects the ink to the maximum ejection amount MP, the ink is prevented from flowing into the second inflow opening 76*r*. This prevents erroneous detection of ink by the ink detecting body 794.

The controller 10 may notify a user of clogging of the first inflow opening 75*r* as well as causing the recording heads 421 to eject the ink.

In this embodiment, the top surface 731*a* of the waste ink tray 731 has a downward slope extending toward the first inflow section 75. The top surface 731*a* of the waste ink tray 731 is not limited to having a downward slope so long as having any other configuration that allows the ink to flow into the first inflow opening 75*r*. For example, the top surface 731*a* of the waste ink tray 731 may be step-like. In this case, the first inflow opening 75*r* is located at the lowest position of the top surface 731*a* of the waste ink tray 731, and the second inflow opening 76*r* is located at a position higher than the position of the first inflow opening 75*r* by the height difference h.

In this embodiment, the ink detecting body 794 is located in the second waste tank 78*b*. The ink detecting body 794 is not limited to being located in the second waste tank 78*b*. For example, the ink detecting body 794 may be located in the second cylindrical section 761 of the second inflow section 76.

In this embodiment, the ventilation hole 732*k* is located in the top surface of the second waste tank 78*b*. The ventilation hole 732*k* is not limited to being located in the top surface of the second waste tank 78*b* so long as being located at any position higher than the ink detecting body 794. With the configuration in which the ventilation hole 732*k* is located at a position higher than the ink detecting body 794, the ink flows into the second waste tank 78*b* smoothly. As a result, it is more accurately detected that the first inflow opening 75*r* is clogged.

In this embodiment, the first inflow opening 75*r* is closed by the ink coagulating and sticking thereto. Alternatively, the first inflow opening 75*r* may be clogged by, for example, accumulation of paper dust from a recording medium.

So far, an embodiment of the present disclosure has been described with reference to the drawings (FIGS. 1-14). The present disclosure is not limited to the above-described embodiment, and may be carried out in any of various forms without departing from the gist thereof. The configuration described in the above embodiment is merely an example, and does not limit the present disclosure in any way. The above-described embodiment may be altered in any of various manners as long as the effect of the present disclosure is substantially provided.

For example, in the above-described embodiment, the present disclosure is applied to a line head unit. The present disclosure is also applicable to, for example, a serial head unit.

What is claimed is:

1. An inkjet recording apparatus comprising:

a recording head configured to eject ink;

a waste ink tray configured to recover the ink;

an ink inflow section located on the waste ink tray, the ink flowing into the ink inflow section:

an ink detecting section configured to output a detection signal indicating whether there is the ink or not; and a controller, wherein the ink inflow section has a first inflow opening and a second inflow opening, the second inflow opening is located at a position higher than a position of the first inflow opening, the ink detecting section detects whether or not the ink has flown into the second inflow opening, and the controller, upon receiving the detection signal, detects that the first inflow opening is clogged.

2. The inkjet recording apparatus according to claim 1, further comprising a tank retaining the ink flowing from the second inflow opening, wherein the ink detection section is located in the tank.

3. The inkjet recording apparatus according to claim 2, wherein the tank has a ventilation hole allowing air to pass therethrough.

4. The inkjet recording apparatus according to claim 3, wherein the ventilation hole is located above the ink detection section.

5. The inkjet recording apparatus according to claim 1, wherein the ink inflow section further includes an umbrella section covering a top portion of the second inflow opening.

6. The inkjet recording apparatus according to claim 1, wherein the waste ink tray has a downward slope extending toward the first inflow opening.

7. The inkjet recording apparatus according to claim 1, wherein an amount of the ink retained in the waste ink tray after the first inflow opening is clogged until the ink flows into the second inflow opening is larger than a maximum amount of the ink ejected by one ejection operation by the recording head.

* * * * *